US010767402B2

(12) United States Patent
Hoffmann et al.

(10) Patent No.: US 10,767,402 B2
(45) Date of Patent: Sep. 8, 2020

(54) DOOR CHECK AND METHOD FOR BLOCKING A DOOR CHECK

(71) Applicant: Edscha Engineering GmbH, Remscheid (DE)

(72) Inventors: Peter Hoffmann, Overath (DE); Gundolf Heinrichs, Remscheid (DE); Torsten Meissner, Remscheid (DE); Matthias Brinker, Heiligenhaus (DE); Heiner Ackers, Herdecke (DE); Dietmar Rehborn, Remscheid (DE)

(73) Assignee: EDSCHA ENGINEERING GMBH, Remscheid (DE)

( * ) Notice: Subject to any disclaimer, the term of this patent is extended or adjusted under 35 U.S.C. 154(b) by 252 days.

(21) Appl. No.: 15/534,475

(22) PCT Filed: Dec. 4, 2015

(86) PCT No.: PCT/DE2015/000571
§ 371 (c)(1),
(2) Date: Jun. 8, 2017

(87) PCT Pub. No.: WO2016/091243
PCT Pub. Date: Jun. 16, 2016

(65) Prior Publication Data

US 2017/0350175 A1 Dec. 7, 2017

(30) Foreign Application Priority Data

Dec. 10, 2014 (DE) ..... 20 2014 009 825 U

(51) Int. Cl.
*E05C 17/00* (2006.01)
*E05C 17/20* (2006.01)
(Continued)

(52) U.S. Cl.
CPC ..... *E05C 17/006* (2013.01); *E05C 17/203* (2013.01); *E05D 11/1014* (2013.01);
(Continued)

(58) Field of Classification Search
CPC . E05C 17/006; E05C 17/203; E05D 11/1014; E05D 11/1057; E05D 3/02;
(Continued)

(56) References Cited

U.S. PATENT DOCUMENTS 5,873,622 A * 2/1999 Kluting ..... E05D 11/082 296/146.11
6,606,763 B1 * 8/2003 Bruckner ..... E05D 3/147 16/366

(Continued)

FOREIGN PATENT DOCUMENTS

CN 1308703 A 8/2001
CN 103982095 A 8/2014

(Continued)

OTHER PUBLICATIONS

Corresponding Search Report for International Application No. PCT/DE2015/000571.

(Continued)

*Primary Examiner* — William L Miller
(74) *Attorney, Agent, or Firm* — Davidson, Davidson & Kappel, LLC

(57) ABSTRACT

The door check includes a retaining bar (20) which can be connected to one of the two door assembly parts, i.e. the door (8) or the door frame (6), and a retaining housing (13) which can be connected to the other door assembly part. In order to design a door check that allows a vehicle door to be reliably and safely blocked in an automated manner, a threaded bar (50) can be accommodated in an axially movable fashion in a cavity of the retaining bar (20).

19 Claims, 2 Drawing Sheets

(51) Int. Cl.
*E05D 11/10* (2006.01)
*E05B 81/08* (2014.01)
*E05D 3/02* (2006.01)

(52) U.S. Cl.
CPC ..... *E05D 11/1057* (2013.01); *E05B 81/08* (2013.01); *E05D 3/02* (2013.01); *E05Y 2201/21* (2013.01); *E05Y 2201/258* (2013.01); *E05Y 2201/266* (2013.01); *E05Y 2400/337* (2013.01); *E05Y 2900/531* (2013.01); *Y10T 16/6295* (2015.01)

(58) Field of Classification Search
CPC ..... E05Y 2201/21; E05Y 2201/258; E05Y 2201/266; E05Y 2900/531; Y10T 16/6295; Y10T 16/61; Y10T 16/304; Y10T 16/5401; Y10S 16/14
USPC ..... 16/86 C, 82, 50, 320, DIG. 14; 296/146.11
See application file for complete search history.

(56) References Cited

U.S. PATENT DOCUMENTS

| | | | | |
|---|---|---|---|---|
| 2003/0093873 | A1* | 5/2003 | Linnenbrink | E05D 11/081 16/85 |
| 2009/0217596 | A1* | 9/2009 | Neundorf | E05B 81/20 49/506 |
| 2014/0217748 | A1* | 8/2014 | Blumenthal | B60N 2/0232 292/144 |
| 2018/0080271 | A1* | 3/2018 | Oster | E05F 15/614 |
| 2019/0145137 | A1* | 5/2019 | Ueno | E05C 17/203 16/82 |
| 2019/0203517 | A1* | 7/2019 | Herrmann | E05F 15/41 |

FOREIGN PATENT DOCUMENTS

| | | | | |
|---|---|---|---|---|
| DE | 4435720 | A1 | 4/1996 | |
| DE | 29812863 | U1 * | 12/1999 | E05C 17/203 |
| DE | 19832502 | A1 * | 1/2000 | E05C 17/203 |
| DE | 29816239 | U1 | 1/2000 | |
| DE | 10007317 | A1 | 9/2000 | |
| DE | 19921213 | A1 | 11/2000 | |
| DE | 19832502 | C2 | 10/2002 | |
| DE | 102006040211 | A1 | 3/2008 | |
| DE | 102007026796 | A1 | 8/2008 | |
| DE | 102011106664 | A1 | 1/2013 | |
| DE | 102011056225 | A1 | 6/2013 | |
| FR | 2830893 | A1 | 4/2003 | |
| JP | 2006169888 | A | 6/2006 | |

OTHER PUBLICATIONS

Chinese Office Action for related Chinese application No. 201580075777.7 and English translation thereof.

* cited by examiner

DOOR CHECK AND METHOD FOR BLOCKING A DOOR CHECK

BACKGROUND

DE 100 07 317 A1 shows a stepless door check for a vehicle door. The door check comprises a spindle rod, which is connected to a vehicle body in an articulated manner at its one end and is accommodated in the vehicle door at its other end, where a braking and fixing device is arranged. The braking and fixing device is accommodated in a retaining housing, wherein the retaining housing surrounds the spindle rod substantially in a rotationally symmetrical manner. To this end, the spindle rod passes through a central cutout in the retaining housing. The spindle rod has an external thread which is engaged with an internal thread of a spindle nut, wherein the spindle nut is mounted in the retaining housing in a rotatable manner by means of a rolling bearing. If a tensile or compressive force is exerted on the spindle rod during an opening or closing process, this results in a rotary movement of the spindle nut. In a rest state of the door, a brake lining is urged axially against a contact face of the rotatable spindle nut by means of a spring force, such that the door is fixed in position. When energized, a longitudinally displaceable electromagnet, which is in the form of a coil arrangement in a housing, moves the brake surfaces counter to the direction of the force of the spring such that the brake lining is taken out of material contact with the spindle nut, with the result that the spindle nut can rotate freely and the vehicle door is no longer fixed in position but is released. In this case, the longitudinally displaceable electromagnet can be triggered by means of sensors.

DE 10 2007 026 796 A1 shows an electrically controllable door check for vehicle doors. A transmission housing that is passed through by a retaining rod embodied as a toothed rack is accommodated in a vehicle door, wherein the toothed rack is connected to the body via a bearing. The toothed rack is engaged with a gearwheel of the transmission housing, wherein this gearwheel is connected to a transmission gearwheel for conjoint rotation, said transmission gearwheel being engaged with a further gearwheel. Brake disks are arranged on an end side of the further gearwheel. A spring element is accommodated in a coil housing and spaces apart an end face of the coil housing, which is configured as a bearing surface, from the brake disks. Furthermore, an annular coil is arranged in the coil housing in an external region of the coil housing, whereas the spring element is arranged in an internal region of the coil housing. In this case, the brake disks and the coil housing are made of a magnetizable material. If the coil is energized, the material is magnetized to such an extent that the brake disks are pressed against the bearing surface of the coil housing, with the result that a friction fit is formed and the door does not move any further. Even when the energizing of the coil ends, the magnetizing is retained and the vehicle door is secured in its position such that only an oppositely energized coil spaces the brake disk apart from the bearing surface of the coil housing again and releases the arrested door. Provision is made for the energizing of the arrested door also to be triggered by external sensors.

DE 10 2011 056 225 A1 shows a stepless door check in which a transmission housing is secured in a retaining housing, wherein the retaining housing is fixed to a vehicle door. The door check comprises a spindle rod with a threaded portion and a thread-free end portion, wherein, in the region of its end portion, the spindle rod comprises a bearing point for pivotable connection to the body and an end stop in the region away from the end portion. In this case, the end stop limits a maximum opening travel of the vehicle door. A spindle nut, which is accommodated in a rotatable manner in the transmission housing, engages with an internal thread in an external thread of the spindle rod. In the region of the thread-free end portion, the spindle nut slides over the spindle rod. A displacement of the spindle nut over the spindle rod is designed to be as friction-free as possible, and so the vehicle door can fly open unintentionally, for example in the event of a gust of wind. In order to avoid this, the spindle nut is additionally provided with an external thread which engages in the manner of a bevel gear with a pinion of a force transmission element. A shaft connected to the force transmission element is connected to a cup-shaped friction element which is accommodated in a resilient manner in a pot-shaped brake surface. If the vehicle door is now moved, the spindle nut rotates about the spindle rod and in this case moves the spindle rod relative to the transmission housing by generated axial forces. At the same time, the rotation of the spindle nut sets the pinion into a rotary movement, since the pinion of the forces transmission element is coupled to an external thread of the spindle nut. As a result, the rotary movement is transmitted through the shaft to the cup-shaped friction element. A coefficient of friction between the cup-shaped friction element and the brake surface can be selected such that a movement of the door has a desired resistance and so, for example, a sudden gust of wind is not capable of unintentionally opening the vehicle door. The end portion of the spindle rod is provided so that, during a closing process of the vehicle door, the spindle nut does not have to rotate about the thread of the spindle rod along a final stretch, but rather can slide over the end portion such that a braking action cannot take effect and the vehicle door closes reliably.

DE 10 2011 106 664 A1 shows a stepless door check in which a retaining rod in the form of a spindle rod is mounted in an axially displaceable manner in a retaining housing. In this case, a spindle nut is accommodated in the retaining housing. The spindle nut is in this case mounted in the manner of a rolling bearing so as to be rotatable about an axis of rotation of the spindle rod, and has, on an inner side, a threaded bore which engages with a threaded bore of the spindle rod. The retaining housing comprises a permanent-magnetic material and a cavity which is formed coaxially with the axis of rotation of the spindle rod, such that an inner wall with a smaller radius of the retaining housing encloses the spindle rod and an outer wall with a larger radius is arranged further away from the axis of rotation of the spindle rod. The mutually facing sides of the inner wall and of the outer wall are magnetically polarized differently. By means of joints, magnetized brake jaws are articulated to the spindle nut, in a rotationally symmetrical manner in the cavity, in the direction of extension of the spindle rod and as a result can rotate about the spindle rod. The retaining housing and the brake jaws are formed in a permanent-magnetic manner such that, in a rest position of the vehicle door, the brake jaws are pressed by magnetic forces against the inner wall of the retaining housing, said inner wall being arranged in a rotationally symmetrical manner between the spindle rod and the retaining jaws. As a result of the brake jaws bearing against the inner wall, facing the spindle rod, of the retaining housing, a frictional force opposes a rotary movement of the spindle nut. As a result of a breakaway torque being overcome, the brake jaws are lifted off the inner wall of the housing by means of a centripetal force in spite of the magnetically attractive action, and are moved in a kind of floating state in the cavity between the inner wall and the outer wall. The outer wall of the housing is in the form of a permanent magnet such that the magnetic force thereof has a repellent action on the brake jaws. If the axial displacement of the spindle rod is noticeably increased, for example by a gust of wind, then the rotary speed of the spindle nut also increases, and as a result so does the centripetal force on the brake jaws, and so the repulsion of the outer retaining housing is overcome and the brake jaws pass into material contact with the outer wall on account of the increased centripetal force, with the result that a frictional force is generated which brakes the rotary speed of the spindle nut and thus also a displacement speed of the spindle rod. In this case, the door check functions on the principle of the centrifugal brake and works without any external energy supply.

DE 199 21 213 A1 shows a stepless vehicle door check in which a retaining housing is connected to a vehicle door or a body via a joint, and a spindle rod which passes through the middle of the retaining housing. The spindle rod is connected to the vehicle door or the vehicle body in a rotationally fixed manner. In an interior of the retaining housing, the spindle rod engages in a thread of a spindle nut, wherein the spindle nut is accommodated in a rotatable manner in a radial bearing. On both end sides of the retaining housing, two plate springs are supported on the two inner sides of the retaining housing in a direction of extension of the spindle rod, wherein the plate springs are supported with their concave sides on supporting faces of the retaining housing and are supported on the opposite convex sides on the spindle nut. Between the retaining housing and the plate springs, balls are arranged in ball races on the plate springs. In a rest position of the vehicle door, equilibrium of forces prevails at the plate springs in a direction of extension of the spindle rod, such that the spindle nut, which is subjected to an axial force on both sides by the plate springs, is located in a central position between the plate springs in the retaining housing. If a tensile or compressive force acts on the spindle rod, an axial force is transmitted to the spindle nut by a tooth engagement of the spindle rod with the spindle nut, such that, depending on the direction of displacement of the spindle rod, one of the two plate springs is pushed in the direction of the retaining housing by the spindle nut, with the result that a curvature of the particular plate spring is reduced. If the axial force is increased further, the ball acts like a fulcrum of a lever, such that a peripheral bearing face of the plate springs is lifted from the housing wall, and so the corresponding plate spring is no longer in direct contact with the retaining housing, with the result that a frictional force between the plate spring and the housing is reduced and the spindle nut is easier to rotate than at the start of a displacement process of the spindle rod. In this state, the plate springs are mounted on a corresponding retaining-house side only by means of the balls. As a result of this, when a vehicle door is opened, initially a greater force has to be applied, but after this greater force has been applied, a vehicle door is easier to open since the coefficient of friction between plate spring in the spindle nut is reduced. If the opening movement is interrupted, an axial force no longer acts on the plate spring, with the result that the plate spring moves the spindle nut back into a position in the middle of the retaining housing, with the result that the original coefficient of friction is reestablished and a stepless retaining position of the vehicle door is adopted. This functions both in an opening direction and a closed direction of the door.

DE 44 35 720 A1 and DE 198 32 502 C2 each show a stepless fixing device for a vehicle door, wherein, during a closing or opening process, a spindle rod with an external thread is moved through an internal thread of a rotatable spindle nut. In this case, the spindle nut is mounted in a rotatable manner on a bearing within a retaining housing. The spindle nut is engaged around by a cable, wherein the two cable ends are fastened to a pivot lever at one fastening point or a plurality of fastening points. The pivot lever is subjected to a force by a compression spring such that a pretensioning force is exerted on the cable. As a result of this pretensioning force, the cable is applied to the spindle nut such that brake torques are generated when the spindle nut rotates. By means of an electric motor which is controllable by external sensors, the pivot lever can be pivoted such that a tension of the cable about the spindle nut is released, with the result that the brake torques caused by the cable are minimized. In this state, fixing of the vehicle door is released and so the vehicle door can be closed or opened.

SUMMARY OF THE INVENTION

It is an object of the invention to create a door check which allows reliable and secure automated fixing of a vehicle door.

According to an aspect of the invention, a door check for a vehicle door is created which comprises a retaining rod which is able to be attached to one of the two door arrangement parts door and door frame, wherein a retaining housing is able to be attached to the other door arrangement part. In this case, a spindle rod is able to be or is accommodated in an axially displaceable manner in a cavity in the retaining rod. Since the spindle rod is accommodated in an axially displaceable manner in the cavity in the retaining rod, the spindle rod is advantageously protected by the surrounding retaining rod, and so a situation is avoided in which, for example, dust or dirt can collect in a thread of the spindle rod and as a result can inhibit a movement of the spindle rod. Furthermore, advantageously, available space can be used optimally in that the spindle rod is accommodated in an axially displaceable manner in the retaining rod and does not take up any additional space outside the retaining rod for the axial displacement. Advantageously, the axial displaceability ensures that the spindle rod is coupled to an opening and/or closing movement of the vehicle door. A spatially fixed spindle rod cannot be coupled to a movement process. Further advantageously, the spindle rod is mounted centrally within the door check by being accommodated in the retaining rod, and so forces that arise act uniformly on the spindle rod. The door check can stop the movement of the vehicle door quickly and reliably by means of a sensor system. This is necessary, for example, when the vehicle door would otherwise collide with another vehicle, a stationary object, such as a wall, for example, or a moving road user.

According to an aspect of the invention, a door check for a vehicle door is created which comprises a retaining rod which is able to be attached to one of the two door arrangement parts that are the door and door frame, wherein a retaining housing is able to be attached to the other door arrangement part. In this case, a spindle nut is arranged on the retaining rod for conjoint rotation, wherein a spindle rod is fitted in the spindle nut. As a result, advantageously, the spindle nut is firmly attached to the door check upon an axial movement of the spindle rod during the opening and/or closing process of the vehicle door, and as a result a moment of force opposes the spindle rod such that the spindle rod is set into a rotary movement when the retaining rod and the retaining housing are displaced axially with respect to one another. In this case, the rotary speed of the spindle rod is defined by the number of turns on the spindle rod per unit of distance. The more turns per unit of distance there are, the higher the rotary speed of the spindle rod, with the opening speed of the vehicle door remaining the same. Since the spindle nut is arranged on the dimensionally stable retaining rod, an arrangement of the spindle nut for conjoint rotation does not damage the retaining rod at an axial pressure which is exerted by the spindle rod, as could be the case for example in a more unstable component.

In a preferred configuration, the spindle nut is arranged in an end region of the retaining rod. Advantageously, this affords the possibility of it being possible to easily fit the spindle nut but also to easily replace it in the event of damage. In addition, a size of the retaining rod can be chosen to be smaller as a result, since otherwise the spindle nut would have to be entirely accommodated in the cavity of the retaining rod. This inevitably results in a larger size of the retaining rod. In addition, this arrangement affords the advantage that the length of the spindle rod is kept as small as possible, since the opening movement of the vehicle door corresponds to a particular displacement of the spindle rod. If the spindle nut were fitted in the interior of the retaining rod, the spindle rod would have to be lengthened by a stretch from the end region of the retaining rod up to the mounting of the spindle nut in the interior of the retaining rod.

Preferably, the axial movement of the retaining rod is converted into a rotary movement of the spindle rod by means of the spindle nut. Advantageously, it is possible as a result to use a brake mechanism which is specifically designed to stop the rotary movements. Such a brake mechanism affords the possibility that it is able to be installed in addition to an axially acting brake mechanism of the door check, resulting in an increase in redundancy. Of course, it is also possible for only the brake mechanism that acts on the rotary movement to be installed in order to stop the movement of the vehicle door. In particular, the axial displacement can be transformed into an in principle freely selectable rotary movement by means of a suitably selected transmission ratio. In the present case, the number of turns of the spindle rod per unit length defines the number of rotations of the spindle rod. In order to achieve a stopping process that is as precise as possible during the opening and/or closing movement of the vehicle door, it is advantageous to choose the transmission ratio such that a high number of rotations of the spindle rod results, so that a large number of revolutions of the spindle rod corresponds to a small axial displacement of the retaining rod.

Expediently, the spindle rod is extendable out of the retaining rod proportionately to a pivoting travel of the door. As a result, a pivoting movement of the vehicle door is coupled directly to the movement of the spindle rod, and so a stopping of the movement of the spindle rod likewise stops the pivoting movement of the vehicle door.

Further expediently, the spindle rod extends substantially in a straight manner. As a result, the spindle rod can be displaced axially within the retaining rod, and lateral dimensions of the retaining rod can be kept small as a result. Alternatively, a curved, flexible spindle rod can be used.

Further expediently, the retaining rod extends substantially in a straight manner. This ensures that the spindle rod, which is preferably likewise configured to extend in a straight manner, is displaceable axially within the retaining rod and that lateral dimensions of the retaining rod are kept small as a result. Alternatively, a curved retaining rod can be used which is adapted to a spindle rod configured in a curved manner and/or is adapted to the pivoting movement of the vehicle door.

According to an aspect of the invention, a vehicle door is created, wherein a retaining rod is able to be attached to one of the two door arrangement parts door and door frame, and wherein a retaining housing is able to be attached to the other door arrangement part. In this case, the retaining rod sets a disk mounted in a fixed position into a rotary movement, wherein the disk is able to be stopped in a contactless manner by an electrically drivable blocking means. Since the retaining rod sets the disk mounted in a fixed position into a rotary movement, an opening movement of the vehicle door is coupled to the rotary movement of the disk mounted in a fixed manner, and so, advantageously, the opening movement of the vehicle door can be stopped by an electrically drivable rotary-movement-blocking means. The contactless stopping of the disk advantageously ensures that no material wear or abrasion takes place and the stopping functions consistently and reliably even after numerous operations.

Preferably, the disk is configured as a permanent-magnetic armature disk having at least two magnetic poles, wherein the electrically drivable blocking means acts on the permanent-magnetic armature disk by means of electromagnetic force action. This advantageously ensures that magnetic forces can be used in order to stop the permanent-magnetic armature disk. As a result of the formation of at least two magnetic poles of the armature disk, the permanent-magnetic armature disk can be fixed at preferred positions in a magnetic field in that energy minima are formed at these positions. Permanent magnets have the property that they retain their permanent-magnetic properties in a substantially unaltered form over long periods of time. As a result, the armature disk functions independently of a power supply, which is the case for example in an electromagnet. In addition, the electromagnetic interaction affords the possibility of contactless stopping. In this case, it is possible to use four, six or eight magnetic poles. If the number of magnetic poles becomes too large, this results in a decrease in the electromagnetic force action on the armature disk, however, since the electromagnetic fields influence each other too much and as a result, depending on the arrangement, could also weaken one another.

In a preferred configuration, the permanent-magnetic armature disk is connected to a spindle rod for conjoint rotation. As a result, the rotary speed of the spindle rod is transmitted directly to the armature disk, and so both the armature disk and the spindle rod exhibit the same rotary speed. As a result, when the armature disk is stopped, the spindle rod is stopped at the same time.

Expediently, the permanent-magnetic armature disk has a signal-generating sensor, wherein the signal-generating sensor detects revolutions of the permanent-magnetic armature disk. As a result, the signal-generating sensor can transmit signals to a connected electronic system in which signals can be processed further. A measurement of the number of revolutions of the permanent-magnetic armature disk can be converted into an instantaneous open position of the vehicle door. Advantageously, it is possible as a result to calculate how far the vehicle door has opened, since the number of rotations is in a functional relationship with the axial displacement of the spindle rod. The axial displacement of the spindle rod is in turn in a functional relationship with an opening angle of the vehicle door. The number of rotations can thus be converted into the instantaneous position taken up by the vehicle door, and it is thus possible to calculate how far the vehicle door is from other objects which are detected by means of a sensor system.

Preferably, the electrically drivable blocking means is configured as an electromagnet, wherein the electromagnet is provided as a coil arrangement which forms at least four magnetic poles. This allows the electrically drivable blocking means to act in a contactless manner and also allows the electrically drivable blocking means to interact with the permanent-magnetic armature disk. In addition, an electrically driven blocking means can be activated on demand, such that, for example, sensors trigger the electrically drivable blocking means. The provision of at least four magnetic poles of the electromagnet makes it possible, in combination with the two poles of the permanent-magnetic armature disk, for a rotary movement of the armature disk to be stoppable after at least 45° when a magnetic field strength is configured in a correspondingly strong manner. Alternatively, it is also possible for two, four, six or eight magnetic poles of the electromagnet to be provided, wherein the number of magnetic poles influences an angular range which the armature disk covers up to the stoppage.

Preferably, the electromagnet and the permanent-magnetic armature disk form what is known as a single-winding rotary actuator, wherein the single-winding rotary actuator stops a rotary movement of the permanent-magnetic armature disk in a contactless manner. In this case, the single-winding rotary actuator allows the permanent-magnetic armature disk to rotate at most through 45° when the electromagnet is energized. As a result, the pivoting of the vehicle door can be stopped even more precisely, the higher the number of turns per unit of distance along the extension of the spindle rod, since in this case, the number of rotations of the armature disk is increased for a particular displacement travel.

According to an aspect of the invention, a door check for a vehicle door is created, wherein a retaining rod is able to be attached to one of the two door arrangement parts door and door frame, and wherein a retaining housing is able to be attached to the other door arrangement part. In this case, a bearing for a spindle rod is arranged on the retaining housing. In this case, the bearing advantageously allows the spindle rod to rotate reliably and uniformly and allows forces acting perpendicularly to the axis of rotation and in the direction of the axis of rotation to be absorbed by the bearing of the retaining housing. In this case, the spindle rod is held in a fixed position and is set into a rotary movement by the associated spindle nut.

According to an aspect of the invention, a door check for a vehicle door is created, wherein a retaining rod is able to be attached to one of the two door arrangement parts that are the door and door frame, wherein a retaining housing is able to be attached to the other door arrangement part. In this case, a cup portion, into which the retaining rod is able to be at least partly introduced, is attached to the retaining housing. Advantageously, the cup portion allows the movable or rotational parts to be accommodated in the cup portion and to be protected thereby.

Preferably, the cup portion is arranged on the retaining housing via legs. Advantageously, as a result, the legs form a holding device for the cup portion. The legs are arranged in a direction of extension of the retaining rod, and so the legs cover subregions of the retaining rod which do not have to be protected against dirt to the same degree as a thread of the spindle rod. By means of the legs, the cup portion can be mounted reliably, such that the latter reliably accommodates rotational parts in its interior and at the same time protects them.

Preferably, the spindle rod is mounted in the cup portion in a deep groove ball bearing. This advantageously allows the spindle rod to be mounted with as little rotation as possible in the cup portion, wherein the cup portion absorbs forces that run and act perpendicularly to the axis of rotation of the spindle rod.

According to an aspect of the invention, a door check for a vehicle door is created, wherein a retaining rod is able to be attached to one of the two door arrangement parts that are the door and door frame, wherein a retaining housing is able to be attached to the other door arrangement part. In this case, a mechanical braking arrangement is arranged in the retaining housing, wherein an electrical braking arrangement acting on the retaining rod is provided outside the mechanical braking arrangement likewise acting on the retaining rod. Advantageously, in this way, the pivoting of the vehicle door can be braked by two different mechanisms which both act on the retaining rod. In this case provision is advantageously made for the mechanical braking arrangement to brake the pivoting of the vehicle door uniformly and as activated by a user, wherein the electrical braking arrangement by means of sensors is capable of executing an emergency stop of the vehicle door if the vehicle door were otherwise going to strike for example another vehicle, another road user or other objects. Since the mechanical braking arrangement is arranged outside the electronic braking arrangement, advantageously, both can act on different positions of the door check.

Preferably, the mechanical braking arrangement is guided along the extension of the retaining rod in a manner offset in parallel to a surface side of the retaining rod. The guidance of the mechanical braking arrangement in a manner offset in parallel along the extension of the retaining rod ensures that the mechanical braking arrangement can act on the retaining rod through an entire range of movement of the door check. During a pivoting movement, a relative movement thus takes place between the retaining rod and the mechanical braking arrangement such that both components are in constant material contact. Preferably, the mechanical braking arrangement acts on a wide surface side.

Preferably, the mechanical braking arrangement is pretensioned against at least one of the surface sides by means of a spring member. This pretensioning sets frictional resistance against the opening movement, preventing the vehicle door from striking an end position of the pivoting too hard. In this case, the spring member can be configured as a gas pressure spring, a spiral spring or some other spring type. The spring member allows reliable, safe and cost-effective pretensioning which generates the frictional resistance between the mechanical braking arrangement and one of the surface sides, such that a brake torque opposes the pivoting of the vehicle door.

Preferably, the retaining rod has profiling along its extension at least on one of the surface sides. The profiling has for example two raised portions and two recessed portions. Alternatively, the profiling is formed by three raised portions and by three recessed portions. Likewise, it is also possible, if necessary, to provide further recessed or raised portions. In particular, the number of recessed and raised portions can also be unequal. Advantageously, as a result, the profiling changes the pretensioning by the spring member along the extension of the retaining rod such that different brake torques are generated.

Preferably, the profiling at least regionally comprises a friction lining or brake lining. As a result, the coefficient of friction between the mechanical braking arrangement and one of the surface sides can be configured in a variable manner.

Expediently, the profiling has at least one catching position for the vehicle door. As a result, the vehicle door is fixed at a preferred opening angle.

According to an aspect of the invention, a door check for a vehicle door is created, wherein a retaining rod is able to be attached to one of the two door arrangement parts that are the door and door frame, wherein a retaining housing is able to be attached to the other door arrangement part. In this case, a link mechanism is attached to the retaining rod and/or the retaining housing, wherein at least a part of the link mechanism is stoppable by an electrically drivable blocking means. In this case, a pivoting movement of the vehicle door can be executed by a four-bar linkage, wherein the four-bar linkage comprises the link mechanism. As a result of the link mechanism being stopped, the pivoting movement of the vehicle door is also blocked in the process.

According to an aspect of the invention, a method for blocking a door check is specified, wherein an electromagnetically acting brake blocks a disk driven by the door check. Advantageously, this allows the electromagnetically acting brake to be controlled by an external sensor and to have constant brake properties throughout its lifetime.

Preferably, a distance or obstacle sensor triggers the electromagnetic brake. As a result, the pivoting movement of the door can be stopped automatically if the pivoting movement of the door would otherwise collide with some other road user or an object.

In a preferred development, an inclination sensor triggers the electromagnetically acting brake. This prevents unintentional pivoting of the door if the vehicle is on a steep slope or the like.

Preferably, an accident or rollover sensor triggers the electromagnetically acting brake. As a result, the vehicle door remains closed even in the event of an accident, thereby increasing the stability of a vehicle body. In addition, the accident or rollover sensor can make an emergency call at the same time, so that for example an emergency call center is informed of the accident.

Further preferably, the electromagnetically acting brake blocks the door in the manner of a child safety lock; this advantageously allows it not to be necessary for the child safety lock to be activated or released at the door itself, but to be controllable, for example, from the driver's cockpit or via a smartphone.

Further advantages, properties and developments of the invention can be gathered from the following description of a preferred exemplary embodiment.

BRIEF SUMMARY OF THE DRAWINGS

The invention is explained in more detail in the following text with reference to the accompanying drawings on the basis of a preferred exemplary embodiment.

DETAILED DESCRIPTION

Figure 1:
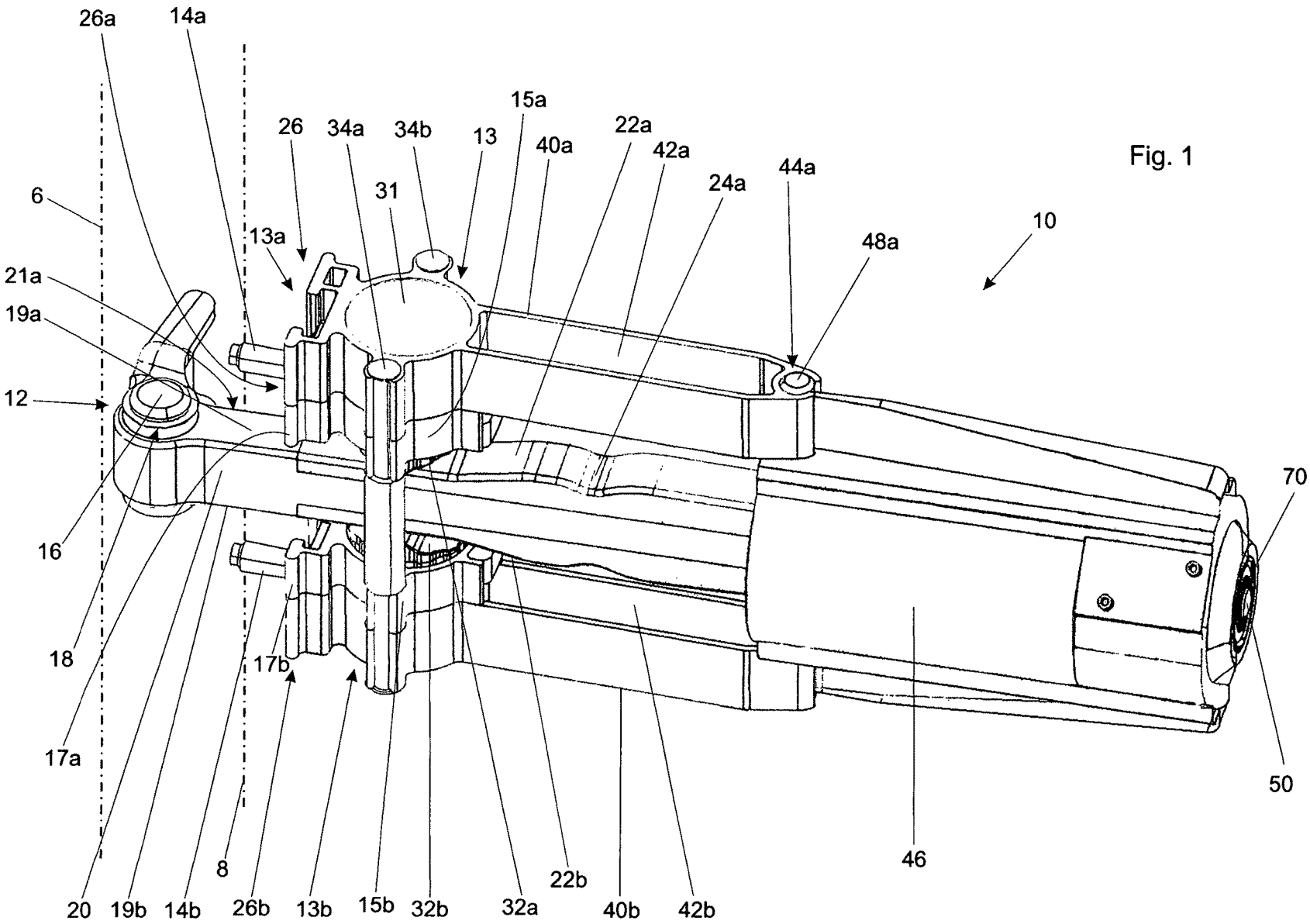
FIG. 1 shows a perspective view of a preferred exemplary embodiment of a door check according to an embodiment of the invention.

FIG. 1 shows a door check 10 for connecting a vehicle door 8, shown schematically as a dot-dash line, in an articulated manner to a door frame 6, shown schematically as a dot-dash line, of a vehicle body, in a closed state of the vehicle door 8.

By means of a joint, the vehicle door 8 is attached pivotably to the door frame 6, such that an axis of rotation of the vehicle door 8 is at least parallel to an axis of rotation of a joint 12. Accommodated in the joint 12 is a rivet pin 16, wherein the rivet pin 16 is mounted in a cylindrical cutout 18 in a retaining rod 20 of the door check 10. The retaining rod 20 is in this case attached rotatably to the joint 12 in a first end region 21*a* of the retaining rod 20. In this case, the retaining rod 20 extends in a straight manner and has a cavity 23 in its interior. An end of the retaining rod 20 that is away from the joint 12 in this case forms a second end region 21*b* of the retaining rod 20.

The door check 10 furthermore comprises a retaining housing 13, which surrounds the retaining rod 20 and in which the retaining rod 20 is accommodated so as to be displaceable along its extension. The retaining housing 13 comprises an upper portion 13*a* and a lower portion 13*b* which are fixed together by two housing rivet pins 34*a*, 34*b*. Both the upper portion 13*a* and the lower portion 13*b* are in this case manufactured as extruded parts. Arranged in each case between the upper portion 13*a* and the retaining rod 20 and between the lower portion 13*b* and the retaining rod 20 is an extruded part in the form of a hollow-cylindrical spacer 15*a*, 15*b*. Fastening-means receiving portions 17*a*, 17*b* are formed in each case on the hollow-cylindrical spacers 15*a*, 15*b* on a side facing the joint 12. The hollow-cylindrical spacers 15*a*, 15*b* are provided in order to space the upper portion 13*a* and the lower portion 13*b* in parallel from the retaining rod 20.

Figure 2:
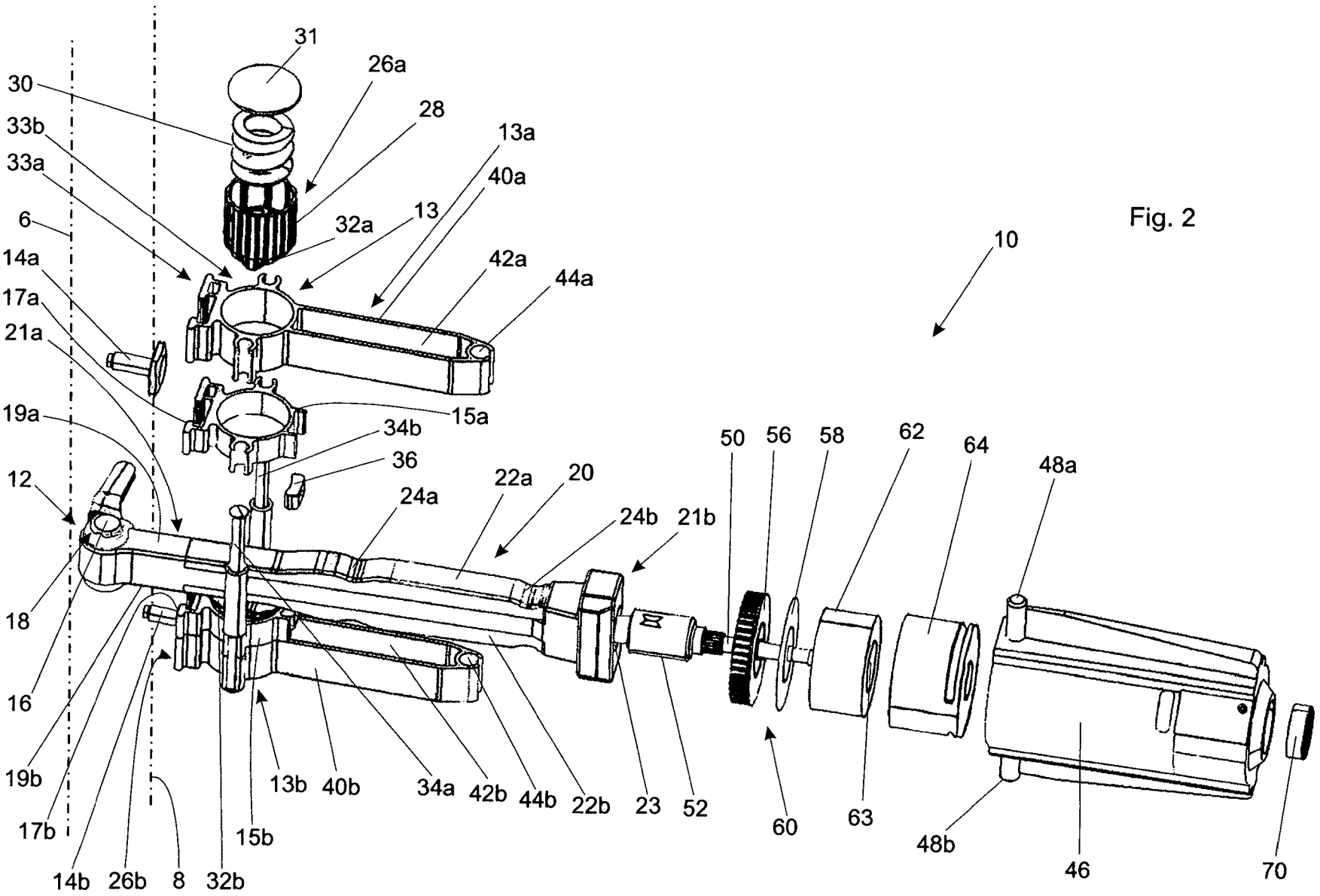
FIG. 2 shows an exploded illustration of the door check from FIG. 1.

Both the upper portion 13*a* and the lower portion 13*b* of the retaining housing 13 comprise (see FIG. 2) a fastening-means receiving portion 33*a*, a cylindrical cavity portion 33*b* and a portion with legs 40*a*, 40*b*. The fastening-means receiving portion 33*a* is in this case located in a region of the retaining housing 13 that faces the joint 12, and the portion with the legs 40*a*, 40*b* is located in a region of the retaining housing 13 that is away from the joint 12. The cylindrical cavity portion 33*b* is located between the fastening-means receiving portion 33*a* and the legs 40*a*, 40*b*. The fastening-means receiving portions 17*a* and 33*a* and the fastening-means receiving portions 17*b* and 33*b* together each form a receiving space for fastening means 14*a*, 14*b*, wherein the fastening means 14*a*, 14*b* are in the form of screws 14*a*, 14*b* in the present case. By means of the screws 14*a*, 14*b*, the door check 10 is attached to the vehicle door 8.

In an extension direction from the first end region 21*a* to the second end region 21*b* of the retaining rod 20, a respective plastic lining 22*a*, 22*b* is formed on two opposite surface sides 19*a*, 19*b* of the retaining rod 20. The surface sides 19*a*, 19*b* and the plastic linings 22*a*, 22*b* in this case face the cylindrical cavity portion 33*b* of the upper portion 13*a* and of the lower portion 13*b* of the retaining housing 13. The plastic linings 22*a*, 22*b* and the retaining rod 20 additionally each have, on the two surface sides 19*a*, 19*b*, two catching positions 24*a*, 24*b* which are in the form of depressions 24*a, b*.

Introduced in the cylindrical cavity portion 33*b* of the retaining housing 13 is a mechanical braking arrangement 26 which is arranged above or below the first end region 21*a* of the retaining rod 20 in a closed state of the door check 10. The construction of the mechanical braking arrangement 26 can be seen better in the exploded illustration in FIG. 2 than in FIG. 1. The mechanical braking arrangement 26 comprises an upper component 26*a* and a lower component 26*b*, wherein the upper component 26*a* is in material contact with the plastic lining 22*a* and the lower component 26*b* is in material contact with the plastic lining 22*b*. At least the upper component part 26*a* of the mechanical braking arrangement 26 in this case comprises a slide sleeve 28 which is accommodated in the cylindrical cavity portion 33*b* of the retaining housing 13 and for its part accommodates a spring member 30, wherein the spring member 30 pretensions the upper component 26*a* against the lower component 26*b* in that the spring member 30 bears, at its one end, against a closure 31 attached firmly to the cylindrical cavity portion 33*b*, such that brake members 32*a*, 32*b* are pressed against the plastic linings 22*a*, 22*b*. Accordingly, the closure 31 forms a counterbearing for a force action of the spring member 30. Preferably, the mechanical braking arrangement 26 stops or brakes an opening process or a closing process of the vehicle door 8 at the catching positions 24*a*, 24*b*.

In addition, a stop damper 36 is attached to the retaining housing 13 in the region of the upper mechanical braking arrangement 26*a*, said stop damper 36 reducing noise and ensuring a more comfortable sensation for a user when opening the vehicle door, in that the stop damper butts against rigid components of the second end region 21*b* at the end of the opening process.

FIG. 1 shows that the two legs 40*a*, 40*b* extend substantially parallel to the retaining rod 20 on a side of the retaining housing 13 away from the joint 12 and are arranged in a plane offset in parallel to the plastic linings 22*a*, 22*b*. In order to reduce weight, the legs 40*a*, 40*b* each have a substantially rectangular cavity 42*a*, 42*b*. The size and shape of the cavities 42*a*, 42*b* are in this case advantageously adapted to the specific requirements and can generally be configured in a variable manner.

On a side of the legs 40*a*, 40*b* away from the joint 12, a pin-shaped cavity 44*a*, 44*b* is in each case provided, wherein a central axis extends through the pin-shaped cavities 44*a*, 44*b* in parallel with the axis of rotation of the joint 12. The pin-shaped cavity 44*a*, 44*b* has the shape of a cylinder, wherein the cylinder does not have a closed envelope, such that an angular range is left open along the extension of the cylindrical cavity 44*a*, 44*b* and a cup portion 46 is able to be inserted into the pin-shaped cavities 44*a*, 44*b* by means of pin-shaped extensions 48*a*, 48*b*. As a result, the cup portion 46 is connected stably to the retaining housing 13. Dimensions of the pin-shaped extensions 48*a*, 48*b* are in this case adapted such that they are able to be introduced into the pin-shaped cavities 44*a*, 44*b* with a precise fit.

Located in the internal region of the cup portion 46, which is concealed in FIG. 1 by an opaque shell of the cup portion 46, is an electrical braking device 60 (see FIG. 2) which is in the form of an electromagnetic single-winding rotary actuator 60. The electromagnetic single-winding rotary actuator 60 brakes a rotary movement. Rotary actuators, which include the single-winding rotary actuator 60, generally comprise a coil arrangement, a stator and an armature. If the coil is energized, then magnetic poles of the coil and magnetic poles of the armature interact with one another such that a torque is generated. In this case, the coil arrangement represents at least four magnetic poles, which are arranged in an alternating manner (plus pole, minus pole, plus pole, minus pole) at an angular spacing of 90°. In the present case, the armature is in the form of a permanent-magnetic armature disk 56 and the coil arrangement is accommodated in an electromagnet 62. The permanent-magnetic armature disk 56 comprises at least two magnetic poles (plus pole, minus pole) which are arranged in opposite regions of the permanent-magnetic armature disk 56. As a result, the permanent-magnetic armature disk 56 is rotated at most through ±45° given a correspondingly strongly selected magnetic field when the electromagnet 62 is energized. A maximum rotational angle of the armature disk 56 is denoted actuating range. The electromagnetic single-winding rotary actuator 60 serves to automatically fix the vehicle door 8 as soon as it is triggered by a sensor system (not illustrated). The constituent parts of the electromagnetic single-winding rotary actuator 60 or the constituent parts which contribute to its functional scope are shown in the exploded illustration in FIG. 2. A displacement of the retaining rod 20 and the opening process of the door check are directly coupled to the rotary movement of the armature disk 56. If the rotary movement of the armature disk 56 stops, the door check 10 and the retaining rod 20 are stopped. A rotational angle of the armature disk 56 of 45° corresponds to a displacement of the retaining rod 20 of one centimeter. Preferably, a rotational angle of 45° corresponds to a displacement of the retaining rod of half a centimeter. The greater the number of turns of the spindle rod 50 per unit length, the more precisely the vehicle door 8 can be fixed.

A spindle rod 50 is received in the cavity 23 at the end of said spindle rod 50 facing the retaining housing 13 and is mounted in a deep groove ball bearing 70 at its end away from the retaining housing 13. In the second end region 21*b* of the retaining rod 20, the spindle rod 50 is in this case arranged in a rotatable manner in a spindle nut 52, wherein the spindle nut 52 is attached to the second end region 21*b* of the retaining rod 20 for conjoint rotation. In a direction from the first end region 21*a* to the second end region 21*b* of the retaining rod 13, the permanent-magnetic armature disk 56, which is connected to the spindle rod 50 for conjoint rotation, is arranged behind the spindle nut 52 in the closed state of the vehicle door 8.

As a result of the closing process or the opening process of the vehicle door 8, the spindle rod 50 is set into a rotary movement by the spindle nut 52, such that the permanent-magnetic armature disk 56 rotates at the same rotary speed as the spindle rod 50. In this case, the electromagnet 62 is arranged in the direction of extension of the spindle rod 50, wherein the electromagnet 62 has a central cylindrical cutout 63 through which the spindle rod 50 passes in a contactless manner. The electromagnet is in this case held rigidly in its position relative to the retaining housing 13 by means of its mounting in the magnet housing 64, which is for its part in turn accommodated in the cup portion 46, such that the electromagnet 62 is not in material contact with the spindle rod 50. Fitted on the spindle rod 50, between the permanent-magnetic armature disk 56 and the electromagnet 62, is a thrust washer 58. The thrust washer 58 in this case represents friction protection between the electromagnet 62 and permanent-magnetic armature disk 56. In addition, the thrust washer 58 ensures that axial guiding precision is ensured throughout the lifetime of the door check 10. On a side of the cup portion 46 remote from the joint 12, the deep groove ball bearing 70 for rotatably mounting the spindle rod 50 in the cup portion 46 is provided.

The electromagnet 62 and the permanent-magnetic armature disk 56 together form the so-called electromagnetic single-winding rotary actuator 60, such that the energizing of the electromagnet 62, which is actuated by the sensor system, results in the armature disk 56 being able to rotate at most through 45° before it is fixed by an electromagnetic force action.

This embodiment of the invention now functions as follows:

FIG. 1 corresponds to the position of the door check 10 with a closed vehicle door 8. During the opening process or during the closing process of the vehicle door 8, a tensile force or a compressive force, respectively, is exerted on the retaining housing 13, with the result that the retaining rod 20 is displaced relative to the retaining housing 13, fixed to the body, in a manner corresponding to a movement of the opening process or of the closing process. As a result of this axial displacement of the retaining housing along the retaining rod 20, the rotationally fixed spindle nut 52 is simultaneously also displaced axially. As a result, the spindle rod 50, which is accommodated in the spindle nut 52, is set into a rotational movement. The permanent-magnetic armature disk 56 is rotationally fixed on the spindle rod 50, such that it exhibits an identical rotary speed to the spindle rod 50.

The opening process of the vehicle door can now be stopped by means of the mechanical braking arrangement 26 in that the retaining rod 20 is moved along the mechanical braking arrangement and the mechanical braking arrangement 26 stops the door check 10 at the preferred catching positions 24*a*, 24*b*.

In this case, the second catching position 24*b* corresponds to a fully open vehicle door, wherein the stop damper 36 in this case butts against the second end region 21*b* of the retaining rod 20.

If the sensor system detects that another road user or some other object would collide with the vehicle door during the opening process, the sensor system emits a signal which energizes the electromagnet 62. The energizing of the electromagnet 62 has the result that the permanent-magnetic armature disk 56 rotates at most through a further 45°, since the two-pole permanent-magnetic armature disk 56 is fixed in a contactless manner by electromagnetic forces by the four-pole electromagnet 62. As a result, the rotary movement of the spindle rod 50, to which the permanent-magnetic armature disk 56 is attached for conjoint rotation, is stopped at the same time, such that the axial movement of the retaining rod 20 is automatically stopped and the opening or closing process of the vehicle door 8 is stopped by the door check 10. The greater the number of turns of the spindle rod 50 per unit length, the more precisely the vehicle door 8 can be fixed.

Furthermore, the sensor system can be configured such that the door check 10 is also stopped by the energizing of the electromagnet 62 during a closing process. For example, the sensor system could detect if a body part such as a finger would be jammed between the vehicle door 8 and door frame 6 if the closing process were to continue.

The invention has been explained above on the basis of a preferred exemplary embodiment, in which the door check is fixed by a spindle rod 50 which is accommodated in an axially displaceable manner in a cavity 23 in the retaining rod 20, wherein a spindle nut 52 is arranged in the retaining rod 20, which sets the spindle rod 50 in rotation upon a relative movement of the retaining rod 20 with respect to the retaining housing 13, and wherein a disk 58 attached to the spindle rod 50 is co-rotated, said disk 58 being able to be stopped in a contactless manner by an electrically drivable blocking means 62. It has to be understood that the disk 58 can also be stopped by contact, for example when the blocking means has a brake lining which comes into contact with an end face of the disk 58 when triggered. If the blocking means is configured to be electrically drivable to this end, this can take place in the form of an electromagnetic actuator which pushes a brake lining connected to an armature of the actuator forward in the direction of the disk 58, for example in the manner of an axially displaceable armature of an electromagnet. In this case, the brake lining comes into abutment against the end face, affording a large area, of the rotating disk and blocks the latter. In addition to the brake lining, further form-fitting means may protrude axially from the pushed-forward part, which allow a form-fitting engagement; to this end, the disk then has corresponding cutouts into which the protrusions can penetrate and which prevent further rotation of the disk. In order to achieve a better form fit, the disk can also be equipped with elevations and depressions which correspond to elevations and depressions of the brake lining, such that mutual rotation is prevented when a brake position is reached. As a result, a particularly small further rotational angle of the disk is advantageously achieved, and so very precise abutment of the blocking means results in very rapid stopping of the retaining rod 20.

The invention has been described above on the basis of an exemplary embodiment in which the relative movement of the retaining rod 20 and retaining housing 13 brought about a rotation of the disk 58 which was then stopped in a contactless manner by a coil. It has to be understood that the relative movement of the retaining rod 20 and retaining housing 13 is also able to be represented by a link mechanism, the links of which are coupled together with one or the other part, and that at least one part of the link mechanism is able to be stopped by an electrically drivable blocking means. To this end, the link mechanism can, in a similar manner to the described exemplary embodiment, set a disk, or an extension of a link, into rotary movement and be stopped magnetically by a coil. The link mechanism can be configured in a two-dimensional or three-dimensional manner and preferably couples the second end region 21*b* of the retaining rod 20 and the retaining housing 13, wherein an elongate extension of the retaining rod 20 is in this case advantageously not necessary, but rather the latter can have a curved shape known from practice. Furthermore, the links of the link mechanism are pivotable in a plane substantially parallel to the plane of the retaining rod, such that the pivoting movement of the links can take place in the vehicle door 8 without the retaining rod 20 being impeded. An extensive housing with a cup 46 and legs 40*a*, 40*b* are then no longer required. It is possible to stop, in a contactless manner, that part of the link mechanism that is able to be stopped by an electrically drivable blocking means, as described above for the disk 58; however, stopping by contact will preferably take place, for example via a brake lining that is actuated by a solenoid valve. That part of the link mechanism that is able to be stopped by the blocking means can also be embodied as part of a piston/cylinder arrangement or of a spindle-nut/spindle-rod arrangement.

The invention has been explained above on the basis of an exemplary embodiment in which the rotary movement of the disk 58 takes place via a spindle rod 50 carrying the disk 58. It has to be understood that the disk 58 can, alternatively, also have a circumferential thread which meshes with a lateral thread of the retaining rod 20 and which is stopped, i.e. in a contactless manner, in the described manner by the described electromagnet. Although a reliable gear coupling to the retaining rod 20 is necessary to this end, the latter can be configured in a curved manner in a known way, and the disk that is provided with an external thread and meshes with the toothing on the retaining rod 20 then has a plurality of permanent-magnetic poles, which are stopped in the described manner. In this case, the electromagnet is not configured coaxially with the retaining rod but is arranged perpendicularly thereto, for example fastened to the retaining housing.

What is claimed is:

1. A door check for a vehicle door, comprising a retaining rod which is configured to be attached to one of a door and a door frame, a retaining housing which is configured to be attached to the other of the door and the door frame, wherein a spindle rod is configured to be accommodated in an axially displaceable manner in a cavity in the retaining rod, wherein a spindle nut is arranged on the retaining rod for conjoint rotation, and wherein the spindle rod is fitted in the spindle nut.

2. The door check as claimed in claim 1, wherein the spindle rod is extendable out of the retaining rod proportionately to a pivoting travel of the door.

3. The door check as claimed in claim 1, wherein the spindle rod extends substantially in a straight manner, and wherein the retaining rod extends substantially in a straight manner.

4. The door check as claimed in claim 1, wherein the retaining rod sets a disk mounted in a fixed position into a rotary movement, and wherein the disk is configured to be stopped in a contactless manner by an electrically drivable blocking arrangement.

5. The door check as claimed in claim 1, wherein a bearing for the spindle rod is arranged on the retaining housing.

6. The door check as claimed in claim 1, wherein a cup portion, into which the retaining rod is configured to be at least partly introduced, is attached to the retaining housing.

7. The door check as claimed in claim 1, wherein an electromagnetically acting brake blocks a disk driven by the door check, and wherein the electromagnetically acting brake stops the disk driven by the door check in a contactless manner.

8. The door check as claimed in claim 1, wherein the spindle nut converts an axial movement of the retaining rod into a rotary movement of the spindle rod.

9. A door check for a vehicle door, comprising:

a retaining rod which is configured to be attached to one of a door and a door frame, a retaining housing which is configured to be attached to the other of the door and the door frame, wherein a spindle nut is arranged on the retaining rod for conjoint rotation, wherein a spindle rod is fitted in the spindle nut, wherein the spindle nut converts an axial movement of the retaining rod into a rotary movement of the spindle rod.

10. The door check as claimed in claim 9, wherein the spindle nut is arranged in an end region of the retaining rod.

11. The door check as claimed in claim 9, wherein the retaining rod sets a disk mounted in a fixed position into a rotary movement, and wherein the disk is configured to be stopped in a contactless manner by an electrically drivable blocking arrangement.

12. The door check as claimed in claim 11, wherein the disk is configured as a permanent-magnetic armature disk having at least two magnetic poles, wherein the electrically drivable blocking arrangement acts on the permanent-magnetic armature disk by electromagnetic force action, wherein the permanent-magnetic armature disk comprises a signal-generating sensor, and wherein the signal-generating sensor detects revolutions of the permanent-magnetic armature disk.

13. The door check as claimed in claim 11, wherein the disk is configured as a permanent-magnetic armature disk having at least two magnetic poles, wherein the electrically drivable blocking arrangement acts on the permanent-magnetic armature disk by electromagnetic force action, and wherein the permanent-magnetic armature disk is connected to the spindle rod for conjoint rotation.

14. A door check for a vehicle door, comprising a retaining rod which is configured to be attached to one of a door and a door frame, a retaining housing which is configured to be attached to the other of the door and the door frame, wherein the retaining rod comprises a spindle nut fixed to the retaining rod, wherein the spindle nut sets a spindle rod having a disk mounted in a fixed position into a rotary movement, and wherein the disk is configured to be stopped in a contactless manner by an electrically drivable blocking arrangement.

15. The door check as claimed in claim 14, wherein the disk is configured as a permanent-magnetic armature disk having at least two magnetic poles, wherein the electrically drivable blocking arrangement acts on the permanent-magnetic armature disk by electromagnetic force action.

16. The door check as claimed in claim 14, wherein the electrically drivable blocking arrangement is configured as an electromagnet, wherein the electromagnet is provided as a coil arrangement which forms at least four magnetic poles.

17. The door check as claimed in claim 16, wherein the electromagnet and the permanent-magnetic armature disk form components of an electrical braking arrangement, and wherein the braking arrangement stops a rotary movement of the permanent-magnetic armature disk in a contactless manner.

18. The door check as claimed in claim 17, wherein a mechanical braking arrangement is arranged the retaining housing, wherein the electrical braking arrangement acting on the retaining rod is provided outside the mechanical braking arrangement likewise acting on the retaining rod, wherein the mechanical braking arrangement is guided along an extension of the retaining rod in a manner offset in parallel to a surface side of the retaining rod, wherein the mechanical braking arrangement is pretensioned against at least one of the surface sides by a spring member, wherein at least one of the surface sides has profiling along the extension of the retaining rod, wherein the profiling at least regionally comprises one of a friction lining and a brake lining, and wherein the profiling has at least one catching position for the vehicle door.

19. The door check as claimed in claim 14, wherein an electromagnetically acting brake blocks the disk driven by the retaining rod, and wherein a sensor selected from the group comprising a distance sensor, an obstacle sensor, an inclination sensor, an accident sensor and a rollover sensor triggers the electromagnetically acting brake.

* * * * *